United States Patent [19]

Phelps

[11] 4,177,739

[45] Dec. 11, 1979

[54] VERTICALLY ADJUSTABLE TABLE

[75] Inventor: Richard D. Phelps, Lakeside, Conn.

[73] Assignee: Back Bay Company, Inc., Wellesley Hills, Mass.

[21] Appl. No.: 939,273

[22] Filed: Sep. 5, 1978

[51] Int. Cl.[2] ..... A47B 9/00

[52] U.S. Cl. ..... 108/144; 108/106; 248/188.2; 248/407

[58] Field of Search ..... 108/144, 148, 146, 106, 108/107, 12; 248/188.2, 188.5, 132, 407, 161, 163, 157; 297/345

[56] References Cited

U.S. PATENT DOCUMENTS

| | | | |
|---|---|---|---|
| 166,628 | 8/1975 | Parks | 108/144 |
| 876,023 | 1/1908 | Schurger et al. | 108/128 |
| 1,113,140 | 10/1914 | Priest | 108/148 X |
| 1,127,287 | 2/1915 | Sadler | 248/188.2 |
| 2,515,911 | 7/1950 | Thomas | 248/157 |
| 2,723,888 | 11/1955 | Bally | 248/157 |
| 2,980,201 | 4/1961 | Ashenfelter | 182/184 |

FOREIGN PATENT DOCUMENTS

| | | | |
|---|---|---|---|
| 104517 | 3/1924 | Switzerland | 108/144 |

*Primary Examiner*—James T. McCall

[57] ABSTRACT

A table has upper and lower sections with the lower section provided with legs having vertically spaced holders and the upper sections having supports engageable therewith. The two sections are interconnected to enable the upper section to be turned in one direction to effect engagement with a selected set of holders and in the opposite direction to effect their release therefrom and the connection between the sections also enables the upper section then to be moved vertically to an extent such that the supports may be seated on another set of holders.

9 Claims, 5 Drawing Figures

VERTICALLY ADJUSTABLE TABLE

BACKGROUND REFERENCES

U.S. Pat. No. 2,515,911
U.S. Pat. No. 2,723,888
U.S. Pat. No. 2,980,201

BACKGROUND OF THE INVENTION

Tables are provided for various uses and in the case of those used in serving food, they differ as to height. For example, a dining table for adults is of one height while a coffee table is much lower and the height of a table for use by children is intermediate.

As space in a home often is limited, it would be a convenience to have a table the height of which was adjustable to enable it to be used for different functions and while tables have been provided with vertically adjustable legs, as far as I am aware, none has been commercially accepted as leg adjustments are not easily made and the construction of legs having that feature detracted from the appearance of the tables.

THE PRESENT INVENTION

The general objective of the present invention is to provide vertically adjustable tables the height of which may be adjusted as required for different uses and that combine ease of adjustments, stability in use, and do not limit designs.

In accordance with the invention this objective is attained by providing a table having a top section and a lower section, the top section including depending and inwardly disposed supports joined to a central, vertical sleeve. The lower section has legs, each extending upwardly and inwardly between two supports and joined to the upper end of a central, depending pivot extending downwardly through the sleeve. The top section is thus capable of being moved vertically and also turned relative to the bottom section to a limited extent. The table includes means to enable the height of the table to be raised with leg mounted, laterally exposed and vertically spaced support holders, each holder engageable by a support when the upper section is held in an appropriate vertical section relative thereto and then turned in the appropriate direction into a position in which that support is seated thereon by gravity. A different table height is established by raising and turning the upper table section relative to the bottom to effect holder and support disengagement and then repositioning the upper section vertically to enable holder and support reengagement with the table held at the different height.

Another objective of the invention is to provide table stability, an objective attained with each leg having a vertically spaced series of holders, each holder of each series engageable by the adjacent support and desirably with means to lock the sleeve to the pivot.

Other objectives and features of the invention will be apparent from the specification and the appended claims.

BRIEF DESCRIPTION OF THE DRAWINGS

The accompanying drawings illustrate a preferred embodiment of the invention

THE PREFERRED EMBODIMENT OF THE INVENTION

Figure 1:
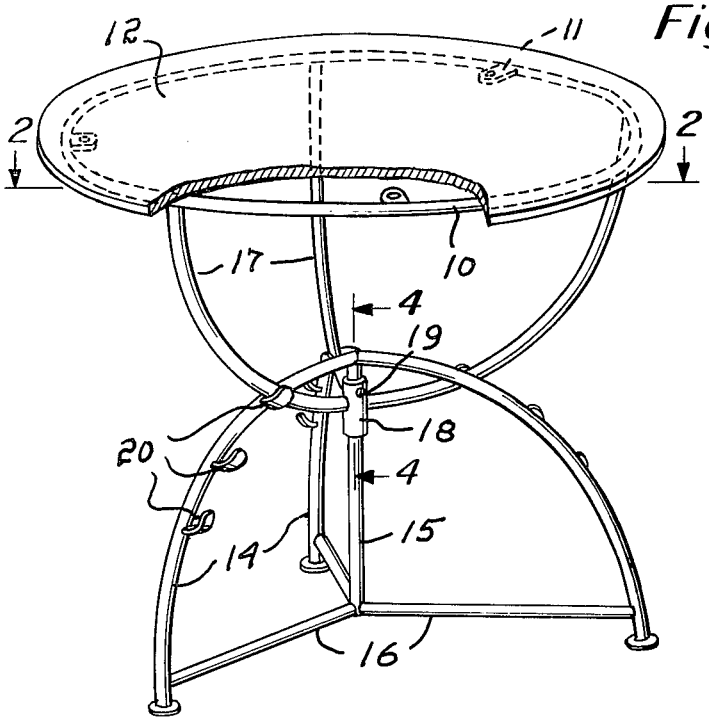
FIG. 1 is a perspective view of a table in accordance with the invention.
Figure 4:
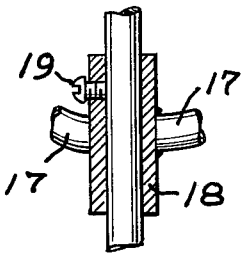
FIG. 4 is a section, on an increase in scale, taken approximately along the indicated line 4—4 of FIG. 1.
Figure 2:
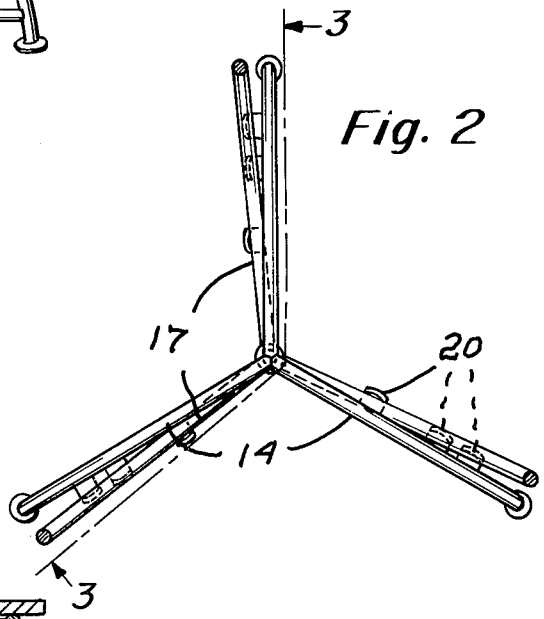
FIG. 2 is a section taken approximately along the indicated lines 2—2 of FIG. 1.
Figure 3:
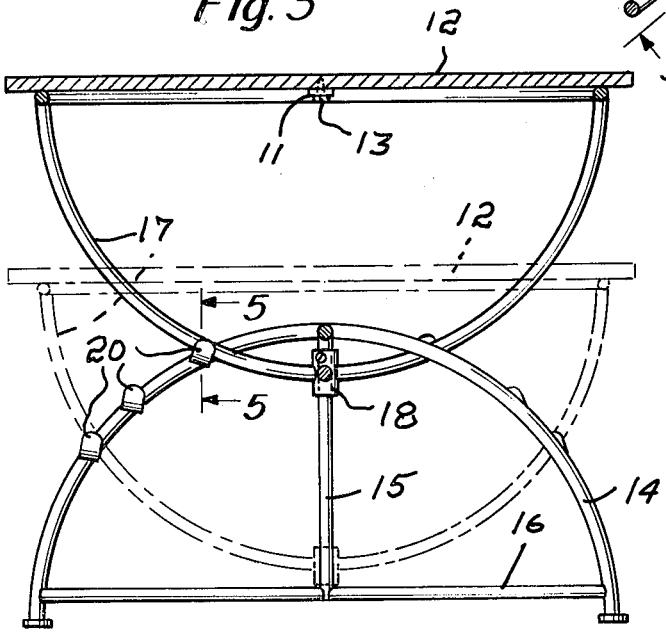
FIG. 3 is a vertical section taken substantially along the indicated line 3—3 of FIG. 2.
Figure 5:
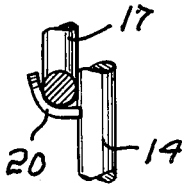
FIG. 5 is a section, on an increase in scale, taken approximately along the indicated line 5—5 of FIG. 3.

The table illustrated by the drawings has a circular frame 10 of tubular stock having a series of inwardly disposed tabs 11 enabling a circular top 12 to be secured thereto by screws 13.

The base is shown as a tripod consisting of three upwardly and inwardly curved legs 14 welded together and to the upper end of a central post 15 which serves as a pivot. The lower end of the pivot 15 is connected to the legs 14 adjacent their lower ends by radially disposed braces 16.

The top includes downwardly and inwardly, equally spaced curved supports 17, each welded at its upper end to the frame 10 and extending between a pair of legs 14 with its inner end welded to a sleeve 18 slidably and rotatably held on the pivot 15 and provided with a set screw 19 enabling it to be locked thereto in a selected vertical position.

In accordance with the invention, each of the legs 14 is provided with a series of upwardly curved, vertically spaced holders 20 all disposed on corresponding sides of the legs and corresponding ones of the several series of holders 20 are in the same plane.

In use, the height of the table can be quickly and easily adjusted. With the sleeve 18 free, and the table top turned so that its supports 17 are clear of the holders 20, the upper table section can be moved vertically relative to the lower section and then turned to bring each support 17 into engagement with the appropriate leg 14 so that it will seat on the selected one of the holders 20. Desirably, the set screw 19 is then tightened to enable the table to be moved by holding the top 12 and to prevent accidental movements of the top 12 that might effect disengagement of the supports from the holders.

We claim:

1. A table comprising an upper section including a top, depending and inwardly disposed supports connected thereto, and a central, vertical sleeve to which the inner ends of the supports are secured, and lower supporting section including legs, each extending upwardly and inwardly between two supports, a central pivot of substantial length extending downwardly through said sleeve, the inner ends of said legs secured to the upper end of said pivot, and means to enable at least two different table heights to be established, said means including leg-mounted, laterally exposed and vertically spaced support holders, each holder engageable by a support when the upper section is held in an appropriate vertical position relative thereto and turned into a position in which that support is seated thereon by gravity.

2. The table of claim 1 and means to lock the sleeve to the pivot.

3. The table of claim 1 in which said leg includes vertically spaced holders.

4. The table of claim 1 in which the leg-mounted support holders enable three different table heights to be established.

5. The table of claim 1 and a connection between the lower end of said pivot and the corresponding ends of the legs.

6. The table of claim 1 in which the supports are downwardly and inwardly inclined and the legs are upwardly and inwardly inclined.

7. The table of claim 1 in which the supports are downwardly and inwardly curved and the legs are upwardly and inwardly curved.

8. The table of claim 7 in which each of the supports and the legs has the same radius.

9. The table of claim 7 in which the top is circular.

* * * * *